US008991079B2

(12) United States Patent
Stewart et al.

(10) Patent No.: US 8,991,079 B2
(45) Date of Patent: Mar. 31, 2015

(54) BUCKET FOR ATTACHMENT TO A MACHINE

(71) Applicant: Caterpillar Inc., Peoria, IL (US)

(72) Inventors: Jimmy L. Stewart, Manhattan, KS (US); Wayne M. Castegnaro, Jr., Wamego, KS (US); Ryan P. Shea, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/721,123

(22) Filed: Dec. 20, 2012

(65) Prior Publication Data

US 2014/0173947 A1 Jun. 26, 2014

(51) Int. Cl.

| | |
|---|---|
| ***A01B 63/16*** | (2006.01) |
| ***E02F 3/40*** | (2006.01) |
| ***E02F 3/96*** | (2006.01) |

(52) U.S. Cl.

CPC . *E02F 3/40* (2013.01); *E02F 3/402* (2013.01); *E02F 3/962* (2013.01)

USPC ..... 37/405; 37/444; 414/607; 414/722

(58) Field of Classification Search

USPC ..... 37/444, 403, 405, 442, 450–453, 37/455–459; 414/722, 723, 724, 912, 607; 294/51; 187/237

See application file for complete search history.

(56) References Cited

U.S. PATENT DOCUMENTS

| | | | | | |
|---|---|---|---|---|---|
| 421,364 | A | * | 2/1890 | Vaag | 294/51 |
| 969,307 | A | * | 9/1910 | Sumerlin | 294/51 |
| 1,107,583 | A | * | 8/1914 | Burchell | 294/51 |
| 2,482,692 | A | * | 9/1949 | Quales et al. | 414/607 |
| 2,496,563 | A | * | 2/1950 | Siems | 414/724 |
| 2,597,374 | A | * | 5/1952 | Richey | 414/724 |
| 2,612,280 | A | * | 9/1952 | Stueland | 414/722 |
| 2,670,862 | A | * | 3/1954 | Siebring | 414/724 |
| 3,115,261 | A | * | 12/1963 | Antolini | 414/607 |
| 3,249,245 | A | * | 5/1966 | Foster | 414/724 |
| 3,270,900 | A | * | 9/1966 | Sherman | 414/303 |
| 3,348,715 | A | * | 10/1967 | Kretz | 414/704 |
| 3,362,554 | A | * | 1/1968 | Fortier | 414/703 |
| 3,498,489 | A | * | 3/1970 | Love | 414/607 |
| 3,795,070 | A | * | 3/1974 | Bronson et al. | 37/405 |
| 3,921,837 | A | * | 11/1975 | Vandewater | 414/24.5 |
| 4,408,946 | A | * | 10/1983 | Haven et al. | 414/424 |
| 4,545,721 | A | * | 10/1985 | Pettersson | 414/724 |

(Continued)

FOREIGN PATENT DOCUMENTS

| | | |
|---|---|---|
| GB | 2084957 | 4/1982 |
| GB | 2460821 | 12/2009 |

*Primary Examiner* — Matthew D Troutman

(74) *Attorney, Agent, or Firm* — Andrew A. Phillips; Miller, Matthias & Hull LLP

(57) ABSTRACT

Machines are often used to collect and transport materials in a work environment. One of the more common methods of collecting and transporting materials is with a fork having tines. Another common instrument attached to a machine for collecting and transporting materials is a bucket. The present disclosure describes a bucket that engages the tines of a fork, and therefore can be used with a machine that already has a fork attached. The present disclosure also engages with tines of multiple lengths, meaning that the same bucket will engage with forks from different machines. The bucket has first and second side members; a collecting member extending between the first and second side members; and an engagement portion having an engagement surface and a pocket.

17 Claims, 10 Drawing Sheets

(56) References Cited

U.S. PATENT DOCUMENTS

| | | | | |
|---|---|---|---|---|
| 4,925,359 | A | 5/1990 | Dunnegan | |
| 5,114,296 | A * | 5/1992 | Badder | 414/607 |
| 5,472,249 | A * | 12/1995 | Fiedler | 294/2 |
| 5,779,430 | A * | 7/1998 | Ball | 414/724 |
| 6,200,083 | B1 * | 3/2001 | Hein | 414/607 |
| 2005/0036875 | A1 * | 2/2005 | Downing | 414/722 |
| 2005/0129494 | A1 | 6/2005 | Chandler et al. | |

* cited by examiner

BUCKET FOR ATTACHMENT TO A MACHINE

TECHNICAL FIELD

The present disclosure relates generally to the design of a bucket to be used with a machine and, more particularly, to a bucket with pockets that engage rollers near the tips of fork tines.

BACKGROUND

Machines, such as fork lifts, wheel loaders, and backhoes, are frequently used in work environments to collect and transport loads. When operating these machines, it is often desirable to utilize auxiliary work implements or equipment with the machine, such as buckets, forks, and grapples, each of which assists the machine in performing work functions. When a machine uses multiple work implements, changing one implement out for another can be a time-consuming and labor-intensive process.

For example, in a forestry mill yard, a fork is often attached to a machine to collect and transport poles around the mill yard. The fork is able to move under the poles and support the weight of the poles when moving the poles in the mill yard. It can also be desirable to attach a bucket to the machine to clean up wood chips and other debris created during the milling process. It is inefficient and labor intensive for the mill yard to remove the fork and attach a bucket when collecting wood chips and debris is desired. After the wood chips and debris are collected, the bucket needs to be detached from the machine and the fork reattached, creating more inefficiency. The mill yard would save time and labor if the fork would not have to be removed from the machine every time the mill yard needed to use the bucket and then reattached after there was no longer a need for the bucket.

U.S. Pat. No. 6,168,369 to Bright discloses a system for attaching a bucket to a fork and transporting it. In this design, the bucket is not used when attached to the fork. The bucket is only attached to the fork so it can be transported between two places. An operator is unable to actually use the bucket when it is attached to the fork. Ultimately, to use the bucket, the operator still needs to disconnect the fork from the machine and connect the bucket. The fork and bucket cannot both be attached to the machine.

The apparatus of the present disclosure alleviates one or more of the deficiencies of the prior art.

SUMMARY OF THE INVENTION

One aspect of the present disclosure is directed to a bucket having a pair of opposing first and second side members; a collecting member extending between the first and second side members; the collecting member and the first and second side members defining a cavity; and an engagement portion having an engagement surface and a pocket.

Another aspect of the present disclosure is directed to a bucket having a pair of opposing first and second side members; a collecting member extending between the first and second side members; the collecting member and the first and second side members defining a cavity; an engagement surface; and a recess.

Another aspect of the present disclosure is directed to a bucket having means for collecting material; means for positioning the bucket relative to a tine; and means for receiving an elevated portion of the tine.

Other features and aspects of this disclosure will be apparent from the following description and the accompanying drawings.

DETAILED DESCRIPTION

Figure 1:
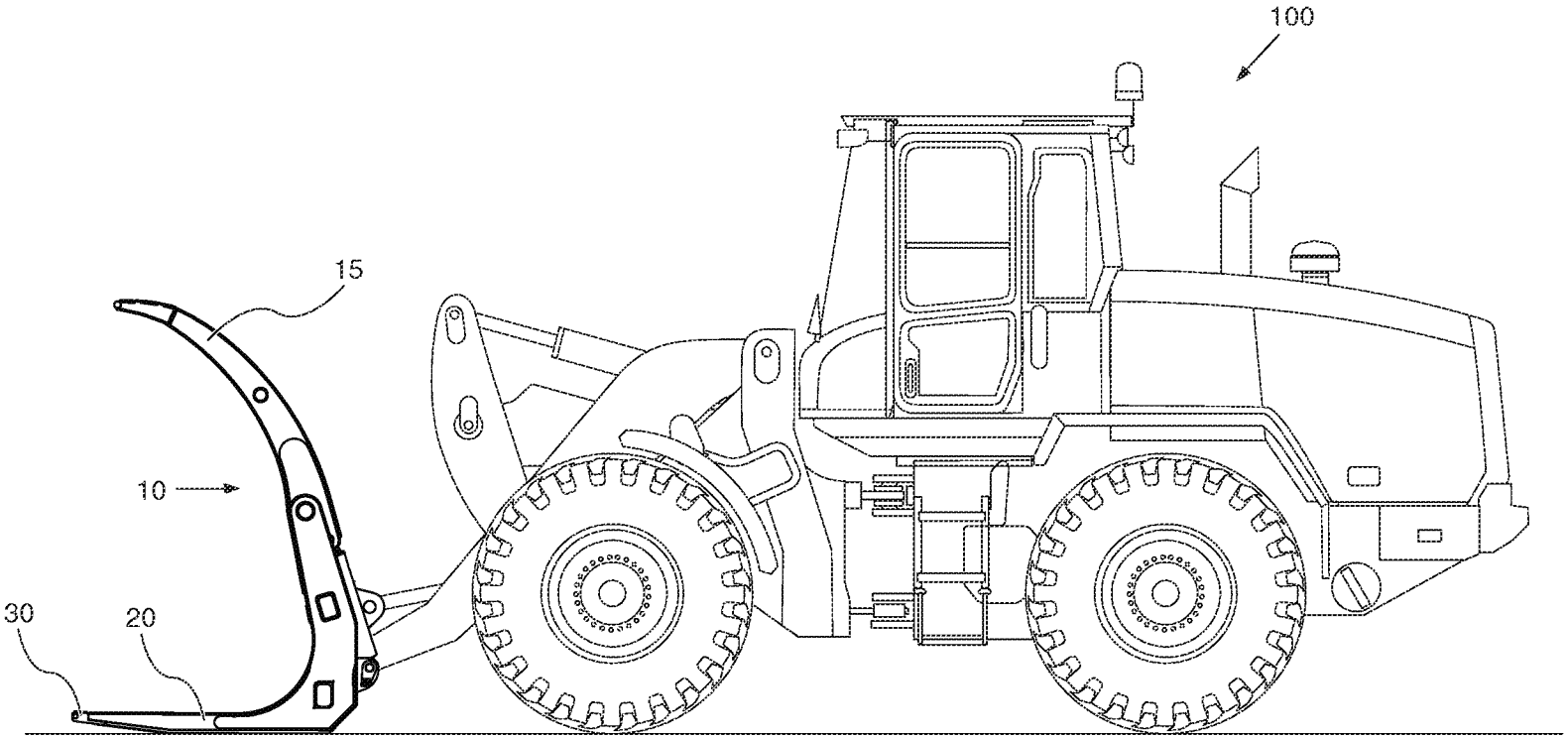
FIG. 1 illustrates a machine with an exemplary embodiment of a fork.

Referring now to FIG. 1, a machine 100 is shown with an exemplary embodiment of a fork 10. Machine 100 may be a fork lift, wheel loader, backhoe, or one of a variety of other machines that may make use of a fork 10. Fork 10 may be removably connected to machine 100, as is well known by a person of ordinary skill in the art.

According to one exemplary embodiment, fork 10 includes at least one tine 20 and a clamp 15. Tine 20 is designed to support a load, and to allow machine 100 to carry the load from one location to another. Clamp 15 assists in retaining and holding the load being transported on tine 20. Near the end of tine 20, there is a roller 30. Roller 30 is free to rotate and helps prevent damage to the load when the load is collected by machine 100. Instead of a sharp tip impacting the load and potentially causing gouging, scarring, and other damage, roller 30 impacts the load and directs the load onto tine 20. Machine 100 generally utilizes a hydraulic system to raise and lower fork 10 as desired by the operator.

Figure 2:
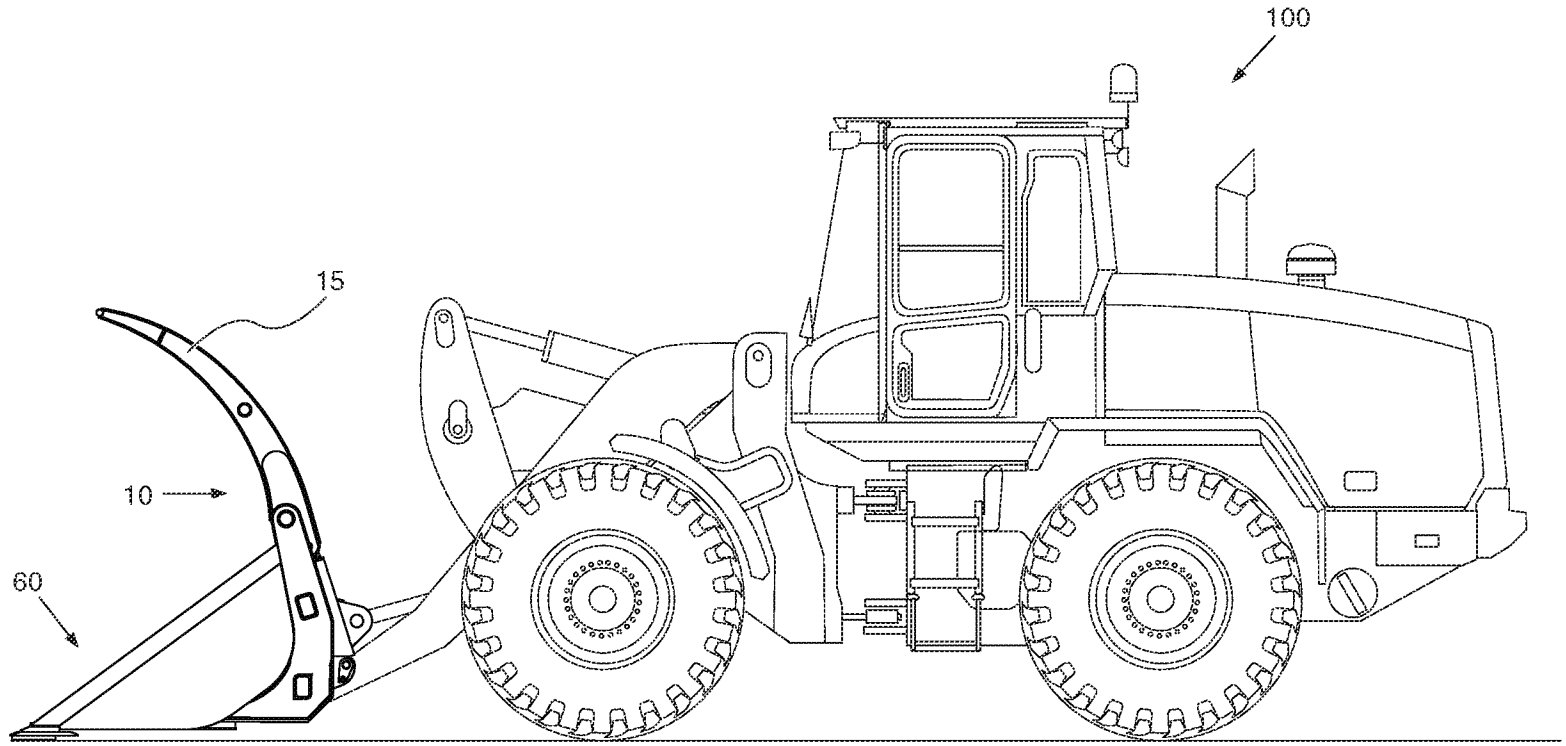
FIG. 2 illustrates a machine with an exemplary embodiment of a fork and an exemplary embodiment of a bucket.

Referring now to FIG. 2, machine 100 is shown with the exemplary embodiment of fork 10, but now with an exemplary embodiment of a bucket 60 attached to fork 10. The design of the present disclosure allows easy attachment of bucket 60 to fork 10, reducing time and labor costs associated with disconnecting a fork from a machine, connecting the bucket to the machine, removing the bucket from the machine, and then connecting the fork back to the machine. The present disclosure allows integration of bucket 60 with fork 10.

Figure 3:
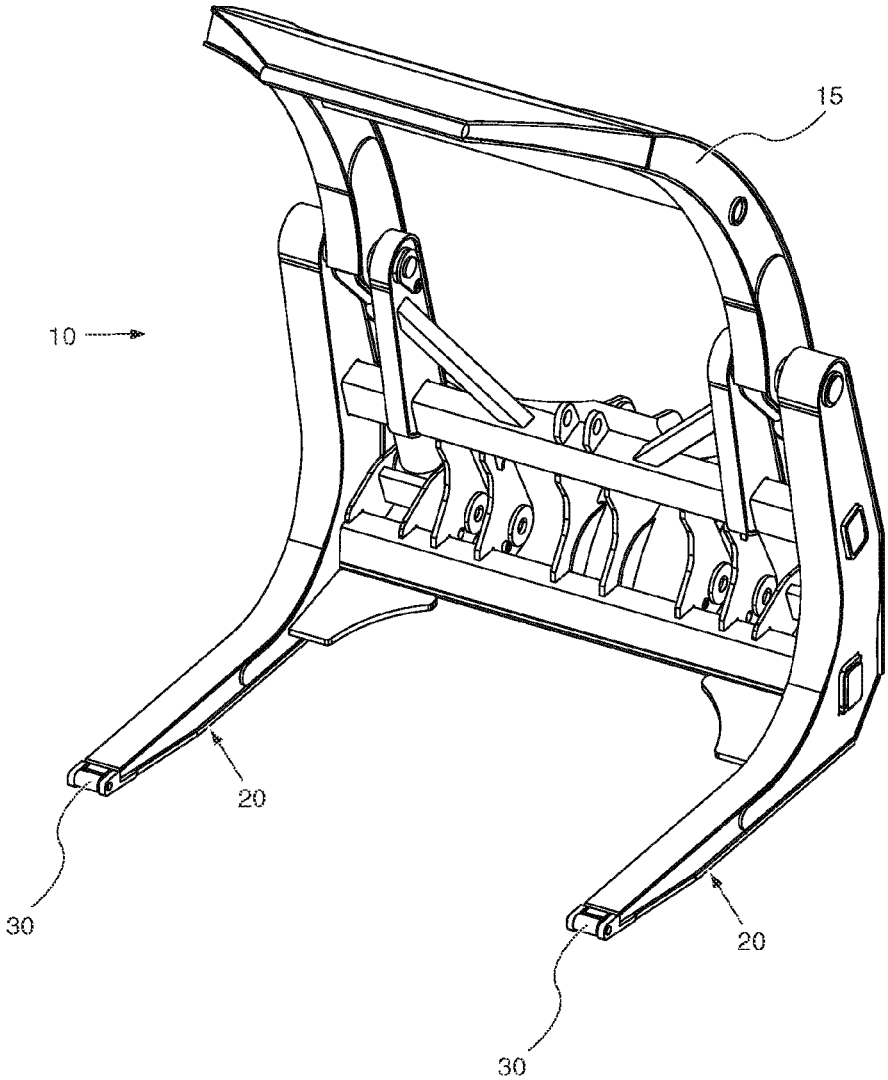
FIG. 3 is an isometric view of an exemplary embodiment of a fork.

FIG. 3 shows an exemplary embodiment of fork 10 in isometric view. Fork 10 has two tines 20. Near the end of each tine 20 is a roller 30. While fork 10 generally contains two tines 20, and is illustrated as having two tines 20 in FIG. 3, the present disclosure anticipates that a fork could be constructed of one tine or multiple tines. Nothing herein is intended to limit a fork to having two tines.

Fork 10 also includes a clamp 15, which assists in retaining and holding material onto tines 20. Clamp 15 can be lowered by the operator when a load is positioned on tines 20 of fork 10 to hold the load in place while the machine is in movement. Clamp 15 will typically be lowered with a hydraulic system. Fork 10 need not include clamp 15, and a person of ordinary skill in the art would recognize that other work implements could be combined with a fork. These other combinations are intended to fall within the scope of the present disclosure.

Figure 4:
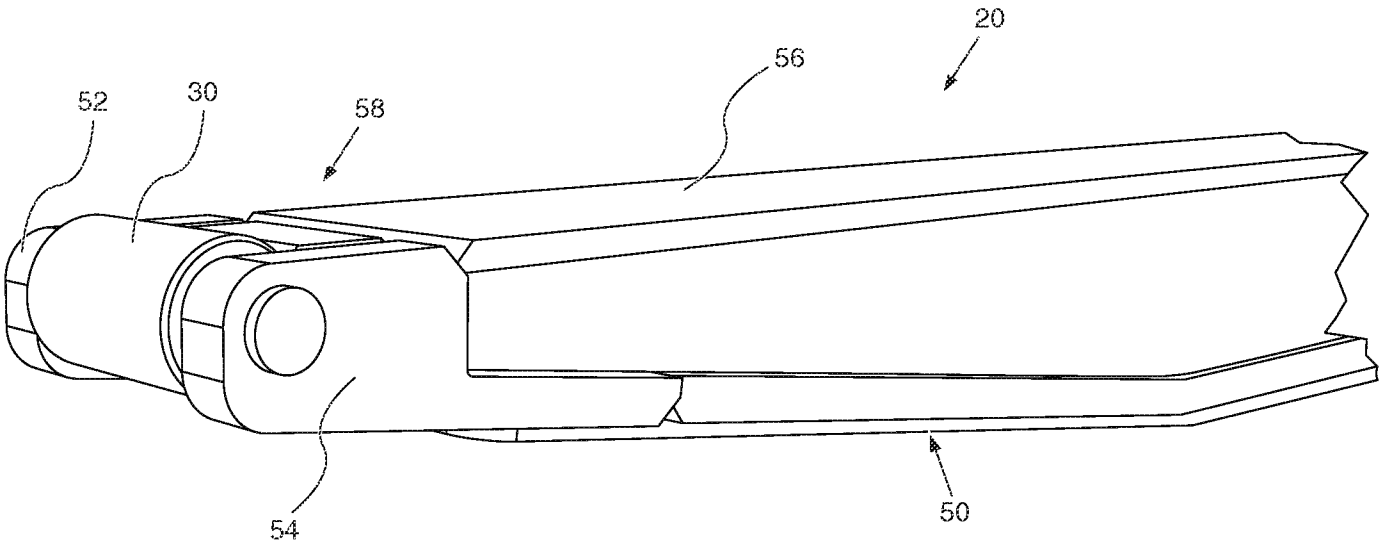
FIG. 4 is a side perspective of an exemplary embodiment of a tine.

Referring now to FIG. 4, a side view of an exemplary embodiment of tine 20 is shown. Tine 20 includes roller 30 and a base member 50. Base member 50 includes a first side wall 52, a second side wall 54, a top surface 56, and a distal end 58. Base member 50 may include a bottom surface, not illustrated, and may be solid or hollow.

In the exemplary embodiment shown in FIG. 4, roller 30 is located adjacent to top surface 56 and distal end 58. A part of roller 30 is elevated above base member 50 and top surface 56. The elevated part of roller 30 serves multiple functions, as will be discussed. A part of roller 30 also extends out in front of first side wall 52, second side wall 54, and distal end 58. By having a part of roller 30 extend out in front of and above base member 50, the possibility of damage to the load during collection is minimized. This is because as the tine 20 approaches the load to be carried, the first part of tine 20 to come into contact with the load is roller 30, instead of the sharp protrusion from first side wall 52, second side wall 54, or distal end 58, which could damage the load. Roller 30 comes into contact with the load without a sharp point, and is able to direct the load onto the top surface 56 of tine 20.

Figure 5:
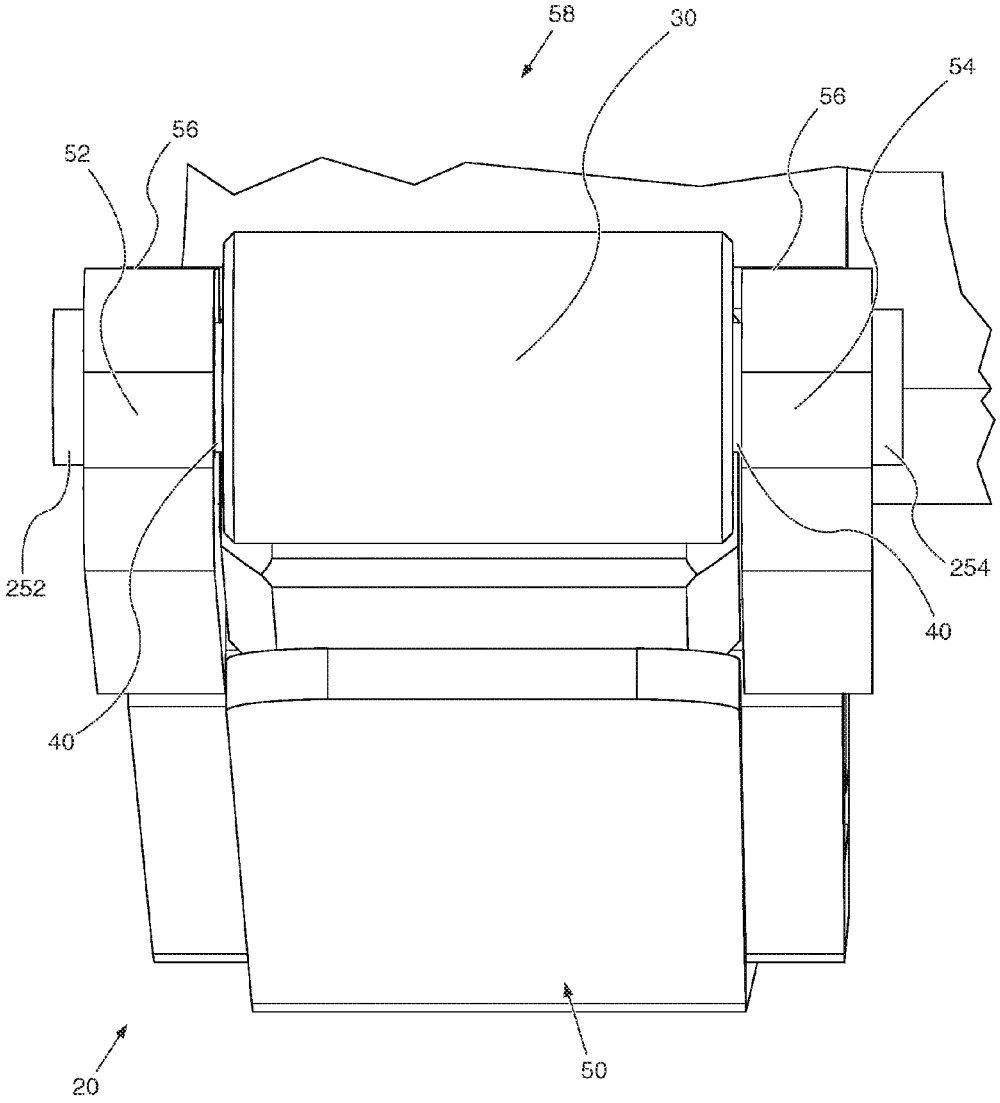
FIG. 5 is a front perspective of an exemplary embodiment of a tine.

In FIG. 5, the exemplary embodiment of tine 20 described with respect to FIG. 4 is shown in a front perspective view. Roller 30 is mounted on a pin 40. Pin 40 is connected to base member 50 proximal to distal end 58 between first side wall 52 and second side wall 54. Pin 40 is held into position in first side wall 52 by a first cap 252 and in second side wall 54 by a second cap 254. Pin 40 does not extend beyond the outer boundary of first side wall 52 or second side wall 54. In fact, the length of pin 40 is less than or equal to the width of base member 50. If pin 40 were to extend beyond the outer boundary of first side wall 52 or second side wall 54, pin 40 could catch on material during the operation of machine 100 and become damaged. This is prevented by making the length of pin 40 reside within the width of base member 50.

In an exemplary embodiment, roller 30 is positioned on pin 40 such that roller 30 is centered with respect to the width of base member 50. Roller 30 may also be fixed on pin 40 and restrained from shifting along the length of pin 40. By centering roller 30 and fixing its position, roller 30 is more effective in preventing damage to the load. Allowing roller 30 to float along pin 40 could result in more damage to roller 30 as it comes into contact with first side wall 52 and second side wall 54, which could shorten the life of roller 30 and require it to be replaced more frequently. It is also desirable to center roller 30 and fix its position to enable tine 20 to properly mate with bucket 60, as will be described.

Figure 6:
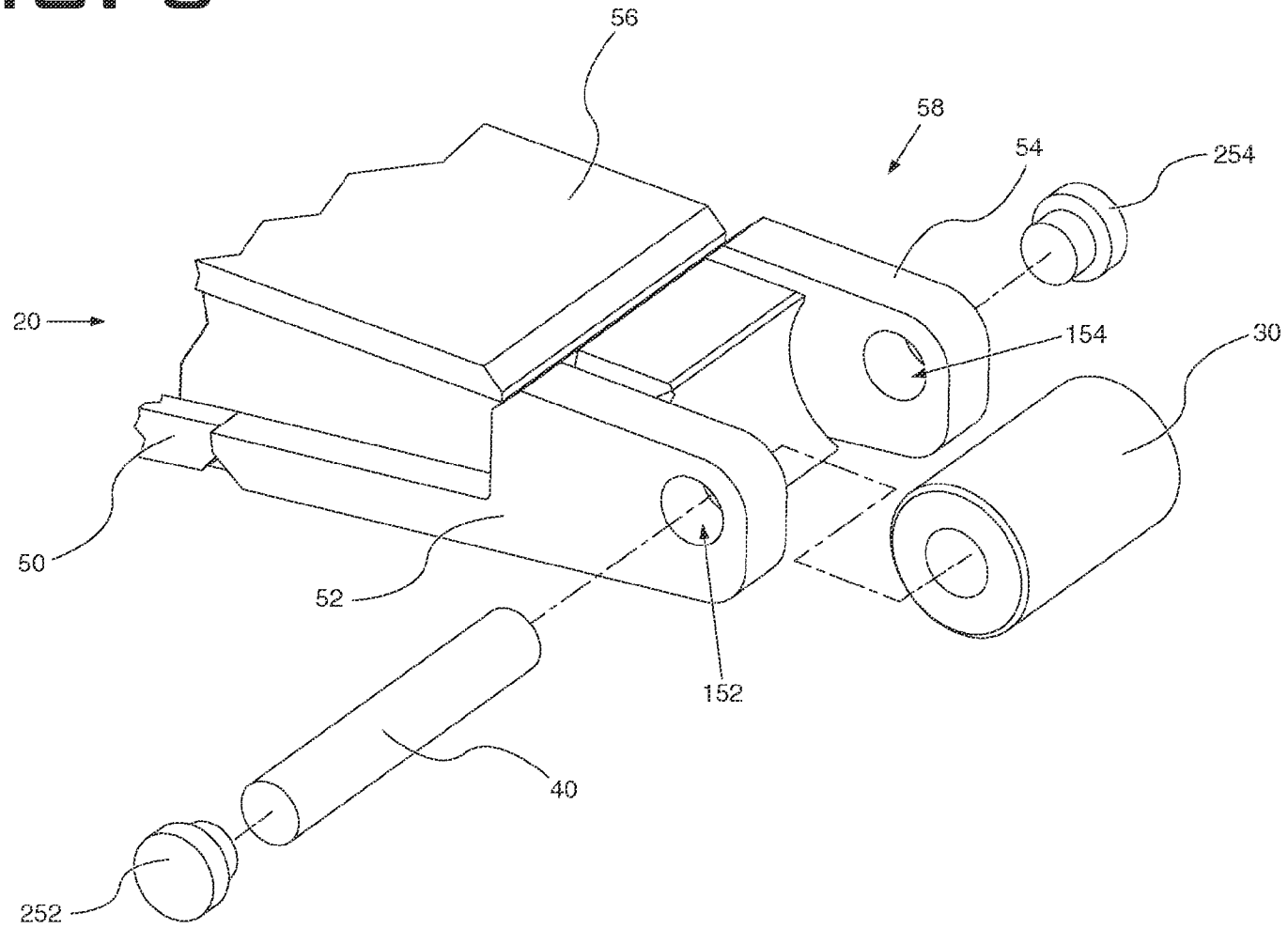
FIG. 6 illustrates an exemplary embodiment of a tine, with a roller and a pin disassembled from the tine.

Referring now to FIG. 6, an exemplary embodiment of tine 20 with roller 30 and pin 40 disassembled from tine 20 is shown. Pin 40 and roller 30 are removable from tine 20, so that each can be replaced should either become damaged during operation of machine 100. Pin 40 is not connected to base member 50 by welding, so that roller 30 and pin 40 may be more easily replaced or repaired.

An axial bore is provided in first side wall 52 creating first hole 152 and second side wall 54 creating second hole 154. Pin 40 mounts in first hole 152 and second hole 154 to mate with base member 50. First cap 252 is then placed into first hole 152 and second cap 254 is placed into second hole 154. The caps are welded to first side wall 52 and second side wall 54 to hold pin 40 in place. To remove roller 30 and pin 40, one cap may be removed to allow access to pin 40. Pin 40 is then removed, freeing roller 30. For ease of removal of roller 30 and pin 40, first cap 252 and second cap 254 may also contain an axial hole, not illustrated, so that when either first cap 252 or second cap 254 is removed, an operator may slide a guide pin, not illustrated, through the axial hole of the remaining first cap 252 or second cap 254, forcing pin 40 out of engagement with base member 50, and freeing roller 30.

In an alternative embodiment, not illustrated, first hole 152 and second hole 154 could be threaded and pin 40 then held in place by screws or other threaded fasteners inserted into first hole 152 and second hole 154.

Figure 7:
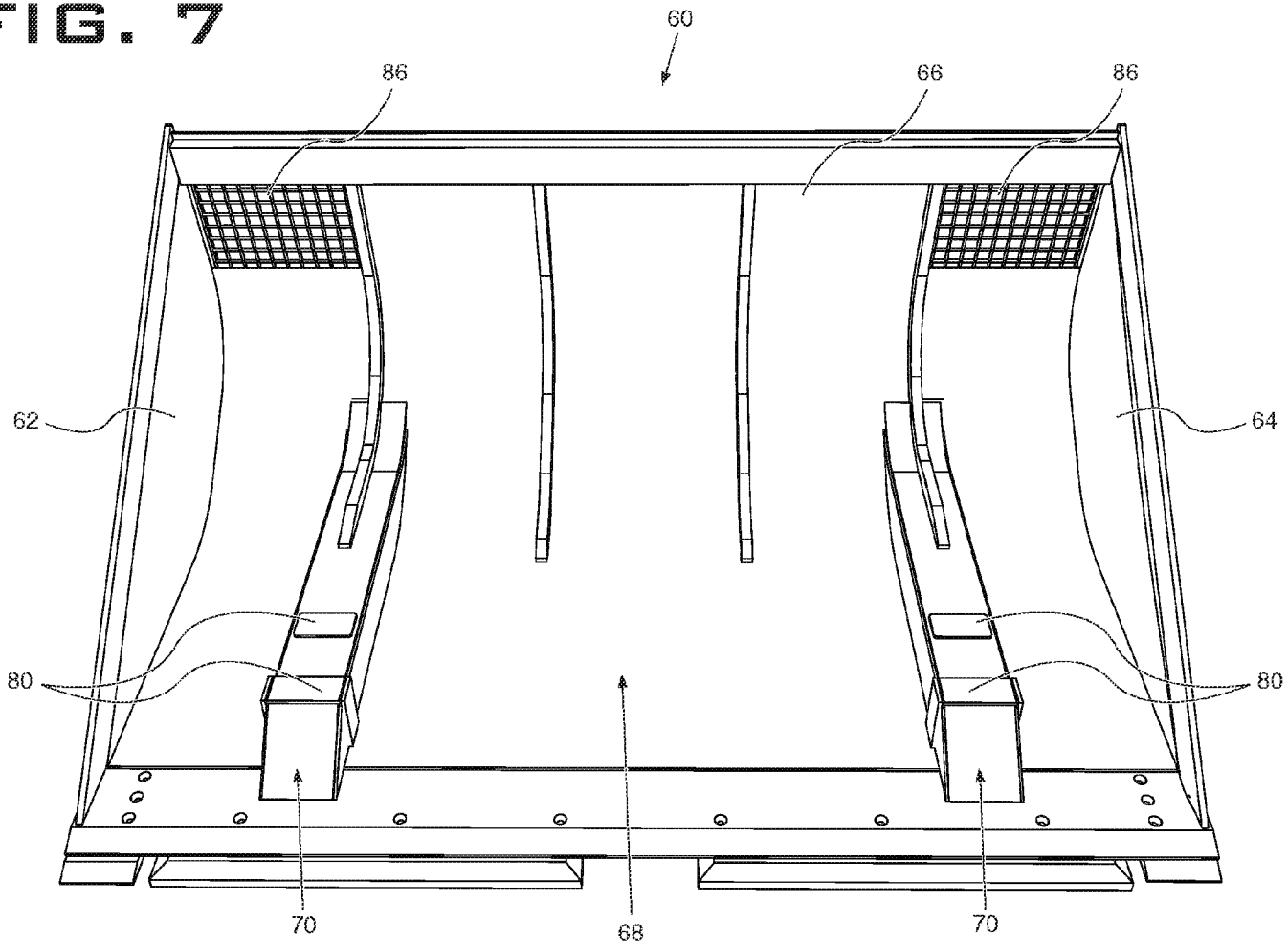
FIG. 7 is a front perspective of an exemplary embodiment of a bucket.

FIG. 7 shows a front view of an exemplary embodiment of bucket 60. Bucket 60 includes a first side member 62, a second side member 64, and a collecting member 66. Together first side member 62, second side member 64, and collecting member 66 form a cavity 68. Bucket 60 is designed to collect and hold material in cavity 68. Bucket 60 may also contain screens 86, which are positioned on bucket 60 to allow the operator to see in front of bucket 60 during collection.

Bucket 60 also includes an engagement portion 70, which includes an engagement surface 72 and a pocket 80. While bucket 60 is shown with two engagement portions 70, and each engagement portion 70 is shown with two pockets 80, the present disclosure anticipates that a bucket could be constructed with one engagement portion or multiple engagement portions. Additionally, each engagement portion could be constructed with one pocket or multiple pockets. Nothing herein is intended to limit a bucket to having two engagement portions, nor is it intended to limit each engagement portion to having two pockets.

Engagement surface 72 is a segment of engagement portion 70, and is the part of bucket 60 that tine 20 will engage with, mate with, or seat on. In FIG. 7, engagement portion 70 extends into cavity 68. Thus, engagement surface 72 is elevated above the lowest point of bucket 60. This allows bucket 60 to be lowered all the way to the ground without interference by tines 20. In other embodiments, the engagement portion may not extend into the cavity of the bucket, or any portion of the bucket at all. For example, the engagement surface may be along the base of the bucket. In that case, only the pocket would extend into the body of the bucket. Depending on the thickness of the base of the bucket, the pocket may or many not extend into the cavity.

Pocket 80 is a region designed to mate with or engage with an elevated portion of tine 60 which, in this exemplary embodiment, is roller 30. In the exemplary embodiment shown, pocket 80 is a physical receptacle, box, or recess that helps to hold roller 30 in place. An operator is able to insert tine 20 into engagement portion 70, and receives auditory, visual, and/or tactile feedback when roller 30 engages in pocket 80 indicating that bucket 60 is properly seated on tine 20. In any alternative embodiment, pocket 80 may define an opening, not illustrated, such that roller 30 would enter a void, but roller 30 would be held in place by the edges around the opening.

Pocket 80 serves an additional function. By accepting roller 30, engagement surface 72 is able to sit flat on top surface 56 of tine 20. This allows the weight of bucket 60 to be more evenly distributed across tine 20. The length of engagement surface 72 in contact with top surface 56 may vary. Ideally, the length of engagement surface 72 will be at least fifty percent of the overall length of bucket 60, and the length of top surface 56 will be at least fifty percent of the overall length of base member 50.

In the exemplary embodiment, bucket 60 contains multiple pockets 80, so that tines 20 of different lengths may be used with bucket 60. Thus, an owner of several forks with different time 20 lengths only needs a single bucket 60. This saves the owner the cost of an additional bucket, as well as the space needed to store an additional bucket.

Figure 8:
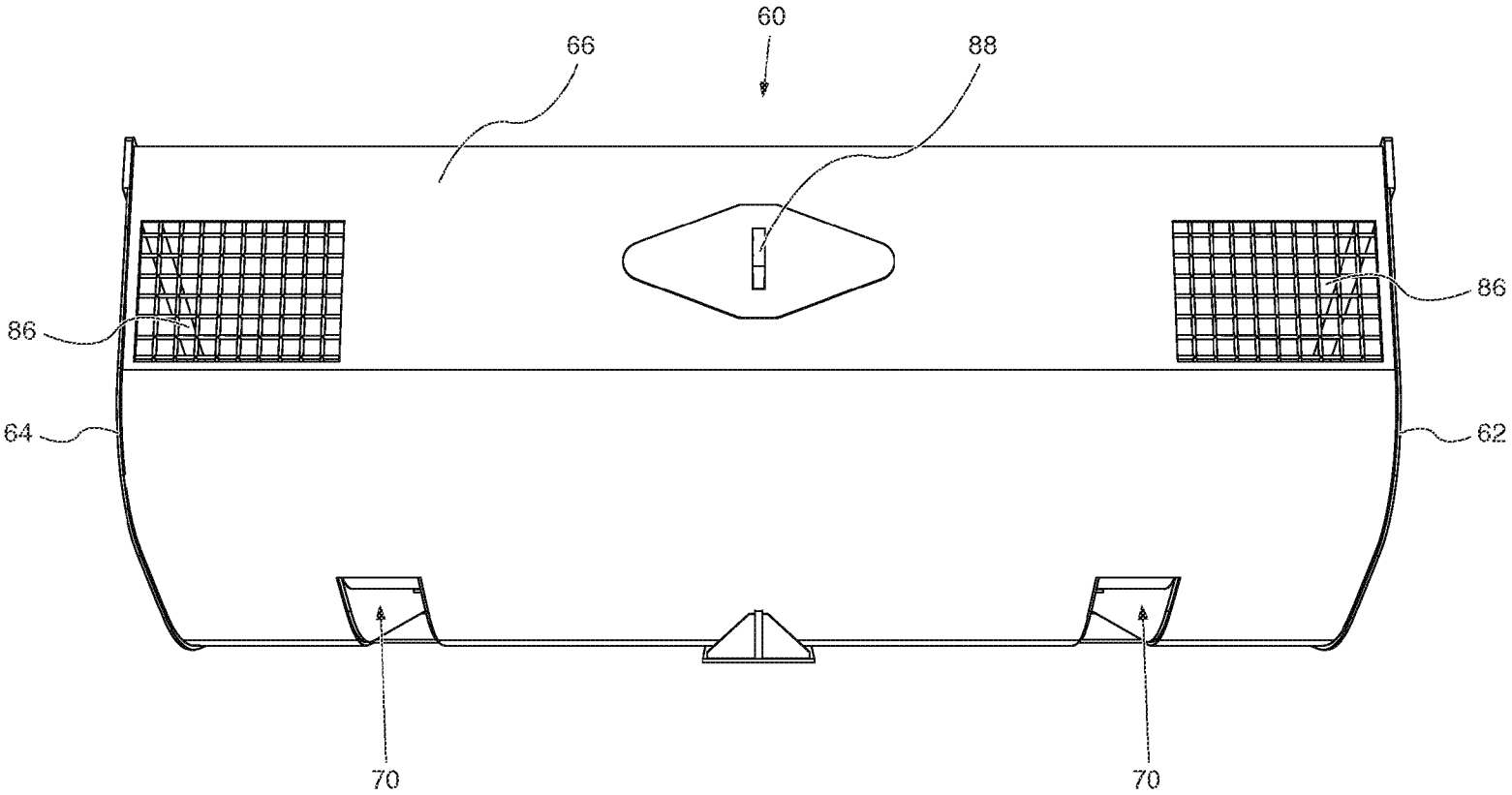
FIG. 8 is a rear perspective of an exemplary embodiment of a bucket.

FIG. 8 shows a rear view of the exemplary embodiment of bucket 60 described with respect to FIG. 7. In the embodiment shown, the engagement portions 70 consist of two channels spaced apart and fitted to receive two tines 20. Screens 86 are shown so that the machine's operator can see in front of the bucket as machine 100 is moving. Bucket 60 also has a connection 88, so that it can be fixed to machine 100, by fixing bucket 60 to fork 10 through the use of a retention pin, not illustrated, that fits into connection 88 and corresponding receptacles located on either machine 100 or fork 10. Other retention mechanisms may also be used.

Figure 9:
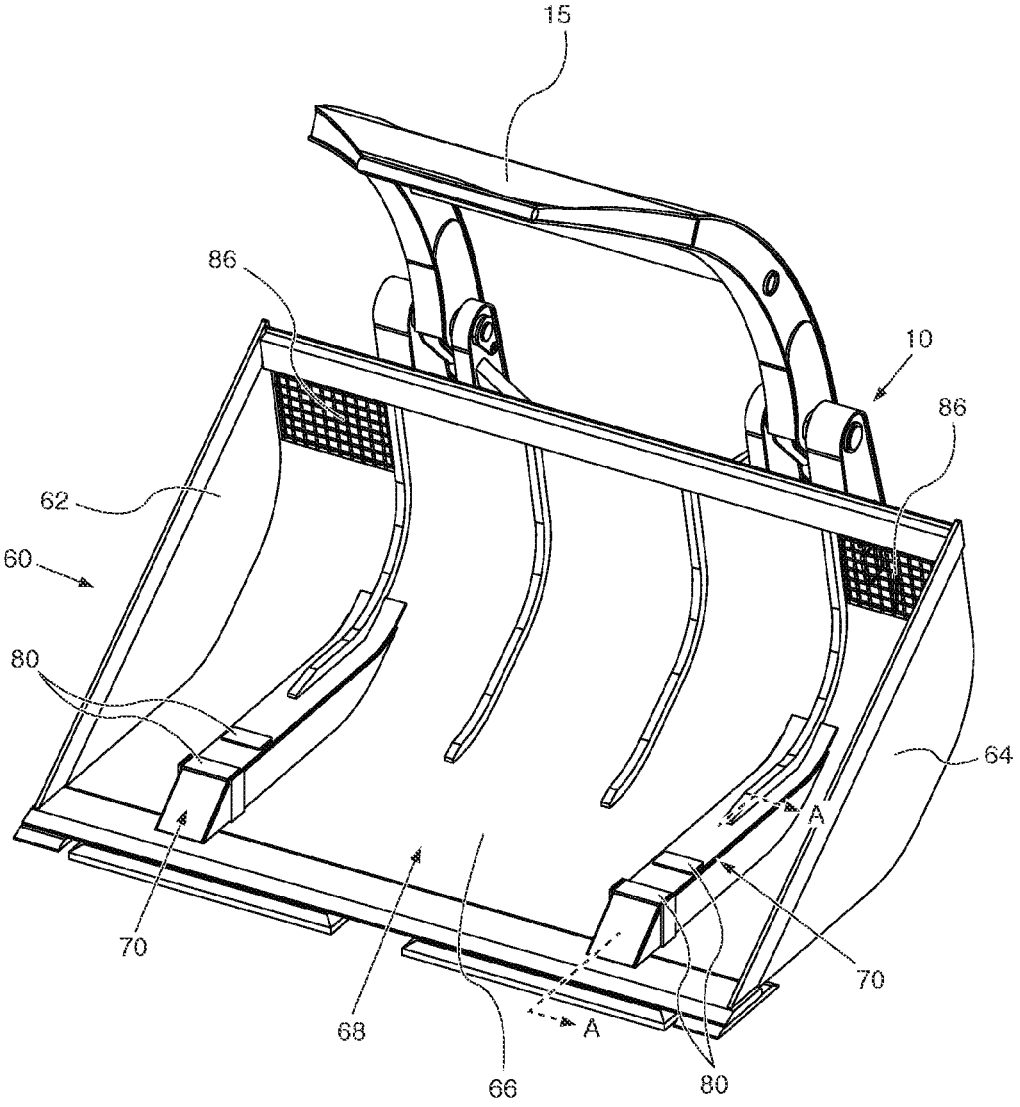
FIG. 9 is an isometric view of an exemplary embodiment of a fork in use with a bucket.

FIG. 9 shows an isometric view of the exemplary embodiment of bucket 60, as described in FIGS. 7 and 8, engaged to fork 10. Bucket 60 is engaged to fork 10 by slipping tines 20 into engagement portions 70 until rollers 30 engage pockets 80. When rollers 30 seat in pockets 80, engagement surface 72 comes into contact with top surface 56 of base member 50, thereby distributing the weight of bucket 60 along base member 50. Dashed line A represents the plane that the sectional view depicted in FIG. 10 is cut along.

Figure 10:
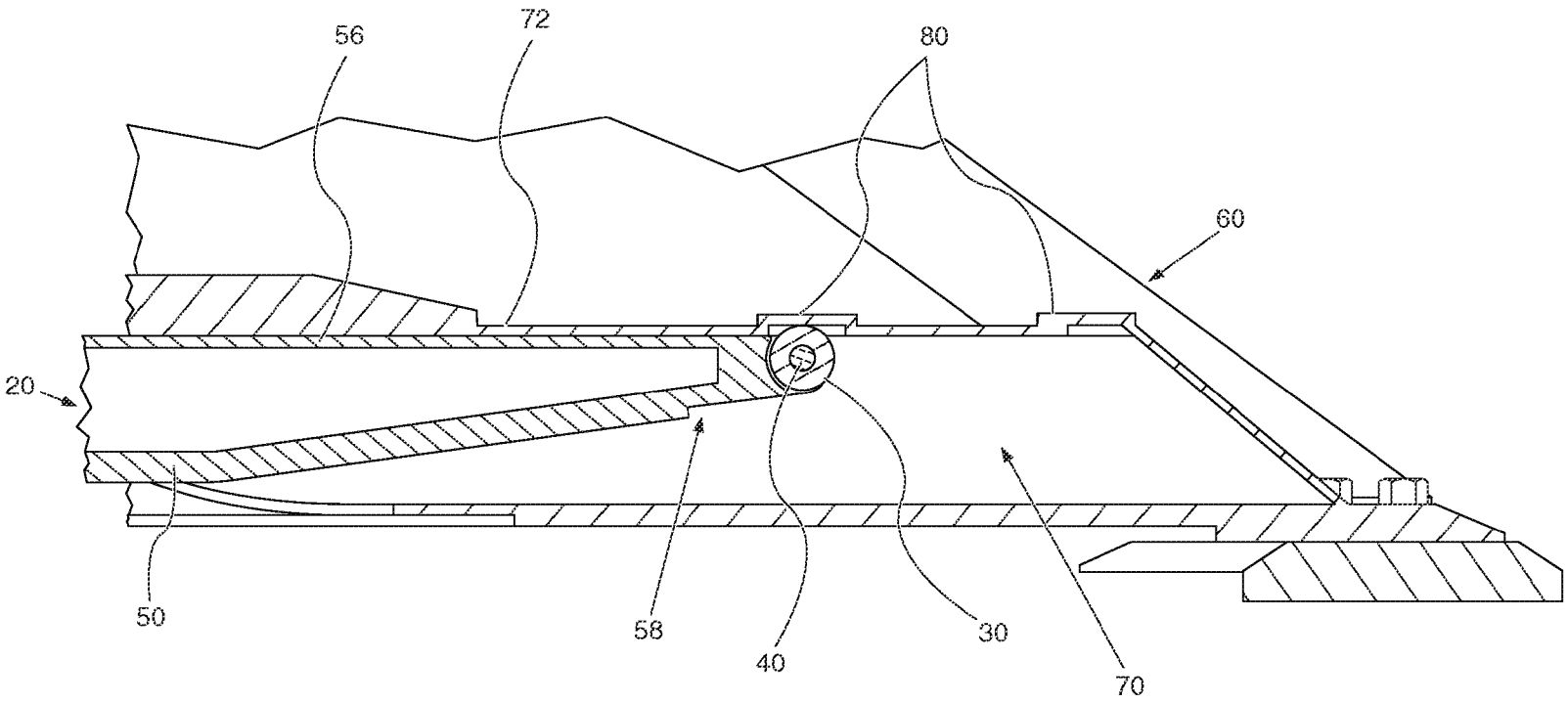
FIG. 10 is a sectional view along an engagement portion of a bucket, illustrating an exemplary embodiment of a tine engaged to a bucket.

FIG. 10 shows a sectional view along tine 20 and engagement portion 70 of an exemplary embodiment of tine 20 engaged to bucket 60. Pockets 80 extend above engagement surface 72. Roller 30 is engaged in one of pockets 80. Because roller 30 is received within in pocket 80, engagement surface 72 is able to rest on base member 50 and, in particular, top surface 56, distributing the weight of bucket 60 along base member 50. Pockets 80, located along engagement portion 70, allow bucket 60 to be connected to tines 20 of different lengths. As a result, bucket 60 can be connected to machines with different tine lengths.

INDUSTRIAL APPLICABILITY

Tine 20 and bucket 60 of the present disclosure may be applicable to any machine using fork 10, including a fork lift, wheel loader, and backhoe. Tine 20 is connected to machine 100 and designed to collect and carry a load. Tine 20 is also designed for connection to bucket 60, so that fork 10 does not need to be disconnected from machine 100 for machine 100 to use bucket 60. Roller 30 on tine 20 is useful in minimizing damage to the load being collected by the machine and to engage tine 20 to bucket 60.

More specifically, in the forestry setting, machine 100 will collect a pole or multiple poles with tine 20, then carry the poles to a destination with tine 20 supporting the weight of the poles. Roller 30 helps to prevent the poles from being gouged and damaged by tine 20 when machine 100 is collecting poles. Without roller 30, the tip of tine 20 is more likely to gouge and damage the pole. With roller 30, however, as machine 100 moves forward, the pole impacts roller 30 and is lifted onto tine 20 with minimal damage.

Should roller 30 or pin 40 become damaged, either may be replaced. According to one exemplary embodiment, pin 40 is not welded onto tine 20, minimizing the amount of time and labor needed to replace a damaged roller 30 or pin 40.

Tine 20 of the present disclosure also allows easy attachment of machine 100 to bucket 60 without having to disconnect tine 20 from machine 100. The operator saves time and labor costs by avoiding the need to disconnect tine 20 from machine 100 and then reattaching tine 20 after using bucket 60. Bucket 60 attaches to tine 20 by having tine 20 engage with engagement portion 70, such that roller 30 fits into pocket 80. When roller 30 fits into pocket 80, bucket 60 rests on top surface 56 and base member 50 of tine 20 allowing the weight of bucket 60 to be distributed over the length of tine 20.

Roller 30 also engages bucket 60, minimizing movement of bucket 60 relative to tine 20. Again, the operator saves time and labor costs through the ease of attaching bucket 60 to tine 20, sliding tine 20 into engagement portion 70 until roller 30 sets into pocket 80, and receiving positive feedback that engagement has occurred. This method avoids the complexity of positioning bucket 60 onto tine 20 and then fixing bucket 60 to either tine 20 or machine 100.

In the forestry setting, bucket 60 is attached to tine 20 to allow machine 100 to collect chips and debris formed during milling operations. While bucket 60 is an important piece of equipment, it is only used for a limited time. So the ability to easily attach and remove bucket 60 is beneficial, and accomplished by slipping bucket 60 onto tine 20 until roller 30 seats in pocket 80. Connection 88 may also be used with a retention pin to lock bucket 60 to machine 100. When machine 100 is finished using bucket 60, bucket 60 can be easily removed from tine 20 by disconnecting the retention pin fixing connection 88 to machine 100, then angling tine 20 slightly downward, causing roller 30 to disengage from pocket 80, and using machine 100 to pull tine 20 out of engagement portion 70.

Additionally, bucket 60 has multiple pockets 80 along the engagement portion 70 to allow bucket 60 to be used with different tines 20. For example, a first machine 100 is equipped with a tine 20 of a first length. A second machine 100 is equipped with a tine 20 of a second length. Ordinarily, each machine 100 would have a separate bucket designed for its specific tine 20 length. However, bucket 60 can be used with both first and second machines 100. Pockets 80 are spaced apart so that both tine 20 of the first length and tine 20 of the second length will engage with bucket 60. This saves the cost of having to purchase a separate bucket for each machine in a fleet. The present disclosure also contemplates buckets 60 with more than two pockets 80 along engagement portion 70, such that bucket 60 can be used with more than two tines 20 of different lengths.

It should also be appreciated that tine 20 of the present disclosure will frequently be combined with clamp 15 or other means of retention, to assist with the retention of the load it is transporting, as is illustrated in FIGS. 1, 2, 3, and 9. For example, in the mill yard, clamp 15 would retain the poles that machine 100 is transporting from an initial point to a destination. Clamp 15 is not the only type of optional work implement that could be combined with fork 10. Those skilled in the art will recognize other work implements that may be combined with fork 10, all of which fall under the scope of the present disclosure.

A person of ordinary skill in the art will also recognize that tine 20 and bucket 60 may be manufactured of a hard, durable metal that will not be easily damaged in a work environment. Such materials are well known and any can be used to form tine 20 and bucket 60. The use of these materials, such as steel and iron, will prolong the life of tine 20 and bucket 60.

It will be apparent to those skilled in the art that various modifications and variations can be made to tine 20 of the present disclosure without departing from the scope of the disclosure. Other embodiments will be apparent to those skilled in the art from consideration of the specification and practice of the device disclosed herein. It is intended that the specification and examples be considered as exemplary only, with a true scope of the disclosure being indicated by the following claims and their equivalent.

What is claimed is:

1. A bucket for receiving a tine having a tine base member and a tine elevated portion, the bucket comprising:

a pair of opposing first and second side members;

a collecting member extending between the first and second side members, and forming a back wall portion and a bottom wall portion of the bucket;

the collecting member and the first and second side members defining a cavity; and a tine engagement portion comprising:

a tine receiving structure configured to receive the tine base member, the tine receiving structure comprising an upper surface that is spaced from the bottom wall portion of the bucket and extends from the back wall portion into the cavity, the tine receiving structure forming an opening in the back wall portion of the bucket through which the tine is received, and a pocket formed within the upper surface of the tine receiving structure, the pocket being disposed as a recessed portion of the upper surface of the tine receiving structure and configured to catchably receive the tine elevated portion so as to limit removal of the tine base member from the tine receiving structure.

2. The bucket of claim 1, wherein the pocket defines an opening.

3. The bucket of claim 1, wherein the pocket extends vertically above the tine receiving structure.

4. The bucket of claim 3, wherein the pocket adjoins the tine receiving structure.

5. The bucket of claim 4, wherein the pocket extends into the cavity.

6. The bucket of claim 5, wherein the tine receiving structure extends into the cavity.

7. The bucket of claim 1, the tine engagement portion further comprising a second pocket.

8. The bucket of claim 7, wherein the first pocket defines an opening.

9. The bucket of claim 7, wherein the second pocket defines an opening.

10. The bucket of claim 7, wherein the first pocket and second pocket are spaced apart.

11. The bucket of claim 7, further comprising a second tine engagement portion comprising:

a second tine receiving structure configured to receive a second tine base member of a second tine, and a third pocket configured to receive a second tine elevated portion of the second tine.

12. The bucket of claim 7, further comprising a second tine engagement portion comprising:

a second tine receiving structure configured to receive a second tine base member of a second tine, and a third pocket configured to receive a second tine elevated portion of the second tine, the second tine engagement portion further comprising a fourth pocket, wherein the third pocket and fourth pocket are spaced apart.

13. The bucket of claim 7, further comprising a second tine engagement portion comprising:

a second tine receiving structure configured to receive a second tine base member of a second tine, and a third pocket configured to receive a second tine elevated portion of the second tine, the second tine engagement portion further comprising a fourth pocket, wherein the third pocket and fourth pocket are spaced apart, wherein the first pocket, the second pocket, the third pocket, and the fourth pocket are elevated above the first tine receiving structure and the second tine receiving structure.

14. A bucket for attachment to a tine having a tine base member and a tine protrusion, the bucket comprising:

a pair of opposing first and second side members;

a collecting member extending between the first and second side members, and forming a back wall portion and a bottom wall portion of the bucket;

the collecting member and the first and second side members defining a cavity;

a tine receiving structure configured to contact the tine base member, the tine receiving structure comprising an upper surface that is spaced from the bottom wall portion of the bucket and extends from the back wall portion into the cavity, the tine receiving structure forming an opening in the back wall portion of the bucket through which the tine is received; and a recess formed within the upper surface of the tine receiving structure, the recess configured to catchably couple with the tine protrusion so as to limit removal of the tine base member from the tine receiving structure.

15. The bucket of claim 14, wherein the recess extends above the tine receiving structure.

16. The bucket of claim 15, wherein the recess adjoins the tine receiving structure.

17. The bucket of claim 15, further comprising a second recess configured to receive a second tine protrusion of a second tine;

the second recess is located along the tine receiving structure and spaced apart from the first recess;

the second recess extends above the tine receiving structure.

* * * * *